US005127155A

United States Patent [19]

Kendic

[11] Patent Number: 5,127,155

[45] Date of Patent: Jul. 7, 1992

[54] METHOD OF TENSION EXPANDING TUBE TO PLATE AND APPARATUS THEREFOR

[76] Inventor: Michael W. Kendic, 1040 Kraft Rd., #4, Memphis, Tenn. 38116

[21] Appl. No.: 128,961

[22] Filed: Dec. 4, 1987

[51] Int. Cl.[5] ..... B23P 15/26

[52] U.S. Cl. ..... 29/890.044; 29/523; 29/727

[58] Field of Search ..... 29/157.3 B, 157.3 C, 29/157.4, 464, 523, 727, 890.044

[56] References Cited

U.S. PATENT DOCUMENTS

| | | | |
|---|---|---|---|
| 3,487,523 | 1/1970 | Ames | 29/523 |
| 3,824,668 | 7/1974 | Wightman | 29/727 |
| 4,459,917 | 7/1984 | Michael et al. | 29/157.3 C |
| 4,584,751 | 4/1986 | Gray et al. | 29/157.3 C |
| 4,584,765 | 4/1986 | Gray | 29/157.3 C |
| 4,720,920 | 1/1988 | Gray | 29/157.3 C |
| 4,734,969 | 4/1988 | Currier et al. | 29/157.3 C |

*Primary Examiner*—Irene Cuda

[57] ABSTRACT

A method and apparatus for tension expanding a plate fin heat exchanger. The plate fin heat exchanger has prebelled hairpin tubes with the bells in contact with the upper tube sheet. The hairpin tubes are expanded one hairpin at a time and the upper tube sheet is gripped to receive the forces of expansion which are transmitted from the prebelled tube ends bearing against the tube sheet.

9 Claims, 2 Drawing Sheets

METHOD OF TENSION EXPANDING TUBE TO PLATE AND APPARATUS THEREFOR

BACKGROUND OF THE INVENTION

This invention relates generally to heat exchanger coils and, more particularly, to a method and apparatus for the tension expanding of plate fin heat exchanger coils one hairpin at a time.

A plate fin heat exchanger coil is commonly constructed with a plurality of flat, parallel plates having laterally spaced holes therein for receiving refrigerant tubes, or hairpin tubes, therein. At each end of the plate fin bundle, there is generally a tube sheet composed of heavier material, and adjacent the upper tube sheet, the open ends of the hairpin tubes are fluidly connected by way of U-shaped return bends that are secured thereto by way of soldering or the like. When the coils are installed into a refrigeration system, the refrigerant is made to flow through the hairpin tubes, and the air to be cooled or heated is made to flow over the plate fins, such that a heat transfer is thereby affected.

As is known, the tube compression expansion process is generally carried out in large presses, in which all the tubes are expanded at one time, by passing tube expanding rods through the open ends of the hairpin tubes and then belling the tube. A backing plate is placed against the hairpin tube bends during compressive expansion to prevent the tubes from being driven out of the unit as the expanding tools are forced therethrough. As a result of this holding action tubes are compressed rearwardly as they are being expanded outwardly by the tools. This in turn, causes the tubes to change length so that the axial length of each tube can vary dramatically in final assembly. Because of the differences in tube length, belling of the tubes is difficult and generally results in uneven or misaligned bells being formed in the tube ends. The return bend therefore cannot be properly seated within the bells leading to the formation of relatively weak or incomplete solder joints in this critical region.

In U.S. Pat. No. 4,584,765 issued to Gray, there is disclosed a technique for tension expanding hairpin tubes into a fin pack unit. This prior technique was generally carried out on a three row coil which was first belled by a split collet and pin arrangement, and then all of the tubes were expanded at one time. Because of the closeness of the heat exchanger tube rows the bells that were formed are simple, single diameter bells, to which pre-tinned return bends are used. Further, because of the closeness of the heat exchanger tube rows, the outer jaw members of the tube clamping fixture were massive while the inner jaw member were relatively long, thin members. In operation, however, these long, thin jaw members bowed or bent in the transverse direction to the direction of the movement of the expanding bullet during the expansion process due to the large forces necessary to expand the coil. Furthermore, the single diameter bell was not suitable for ultrasonic soldering, but had to use pretinned return bends. Thus, to use ultrasonic soldering, the bell diameter would have had to be increased, which would have required even less space between adjacent tubes, making the jaw member even thinner and subject to more bowing.

A further disadvantage of the prior compression or expanding devices is that they were not very flexible in manufacturing coils of different configurations. As a consequence, the manufacturing of a variety of different coils is time consuming and costly due to the set-up time necessary to change expansion rods and hairpin receiver blocks when changing from one coil configuration to another coil configuration.

Thus, there is a clear need for a tension expander that can be used to tension expand many different configurations of plate fin heat exchanges without gripping the tubes as they are expended.

SUMMARY OF THE INVENTION

It is an object of the present invention to simplify the manufacture of plate fin heat exchangers.

It is another object of the present invention to tension expand many different configurations of plate fin heat exchangers wherein the tension expansion stroke exerts a minimum force on the coil.

It is a further object of the present invention to reduce the manufacturing cost of a plate fin heat exchanger by eliminating the need for large expanders which require large application forces.

It is still another object of the present invention to provide a safe, economical and reliable method of manufacturing many different configurations of plate fin heat exchangers with rapid changeovers.

These and other objects of the present invention are attained by a method of tension expanding one hairpin at a time of many different configurations of plate fin heat exchangers. The method includes clamping a prebelled coil by the tube sheet in alignment with an expander, positioning the expander to expand individual hairpins whereby the forces of expansion are transmitted from the prebelled tube end, which bears against the tube sheet holes, to the clamped tube sheet.

A tension expander is further disclosed including three individually actuated expander rods mounted on a frame which provides two-axis motion to the expander rods, an adjustable support means for supporting coils of different configurations, a clamping means for securing the front tube sheet to the adjustable support means, an adjustable carriage means having blade means for supporting the rear tube sheet and compressing the coil to a desired size, whereby individual hairpins are expanded one at a time thereby eliminating the tube grippers since each expansion stroke results in only a small force transferred to the coil.

The various features of novelty which characterize the invention are pointed out with particularity in the claims annexed to and forming a part of this specification. For a better understanding of the invention, its operating advantages and specific objects attained by its use, reference should be had to the accompanying drawings and descriptive matter in which there is illustrated and described a preferred embodiment of the invention.

BRIEF DESCRIPTION OF THE DRAWINGS

Other objects and advantages of the present invention will be apparent from the following detailed description in conjunction with the accompanying drawings, forming a part of this specification, and in which reference numerals shown in the drawings designate like or corresponding parts throughout the same, and in which.

DESCRIPTION OF THE PREFERRED EMBODIMENT

Figure 1:
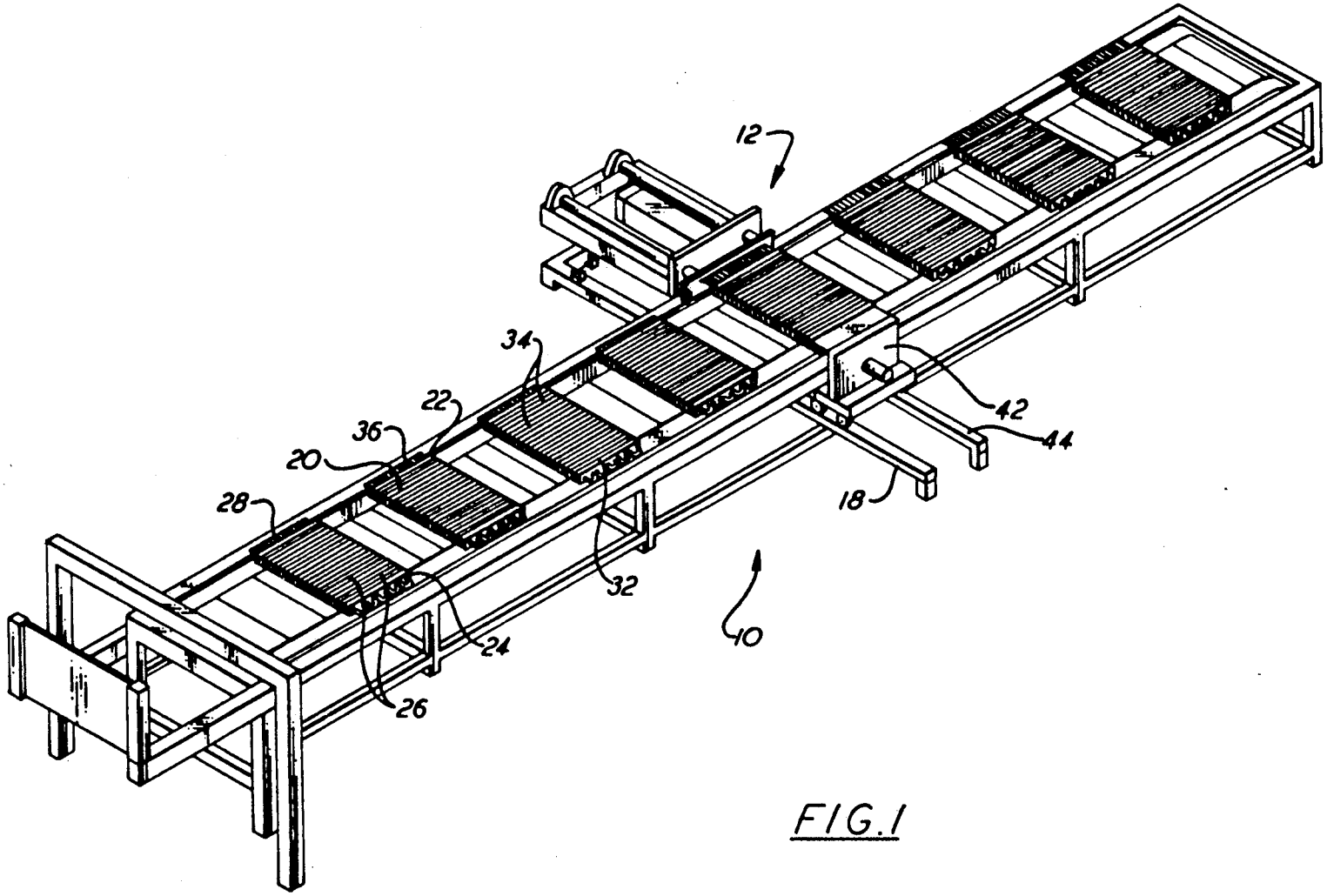
FIG. 1 is a perspective view of a plate fin coil assembly apparatus embodying the teachings of the present invention.

Referring to FIG. 1, there is shown a portion of a plate fin heat exchanger assembly system 10 with the various components used in accordance with the method and apparatus of the present invention. The present plate fin coil expander is described in connection with tension expander station 12. Prior to arriving at the expander station 12, the plate fin heat exchangers 20 are partially assembled and belled at a lacing-belling station (not shown). As may be seen a plate fin heat exchanger has a plurality of fins 26, a bottom tube sheet 24 and a top tube sheet 22. Hairpin tubes 28 are arranged having a return portion 32 and leg portions 34 such that the leg portions extend through the entire fin bundle and tube sheet 24 to tube sheet 22 and extend beyond tube sheet 22 defining belled extension portions 36. The hairpin tubes are physically inserted or laced through arranged openings in the fins and tube sheets into the positions as shown.

Figure 2:
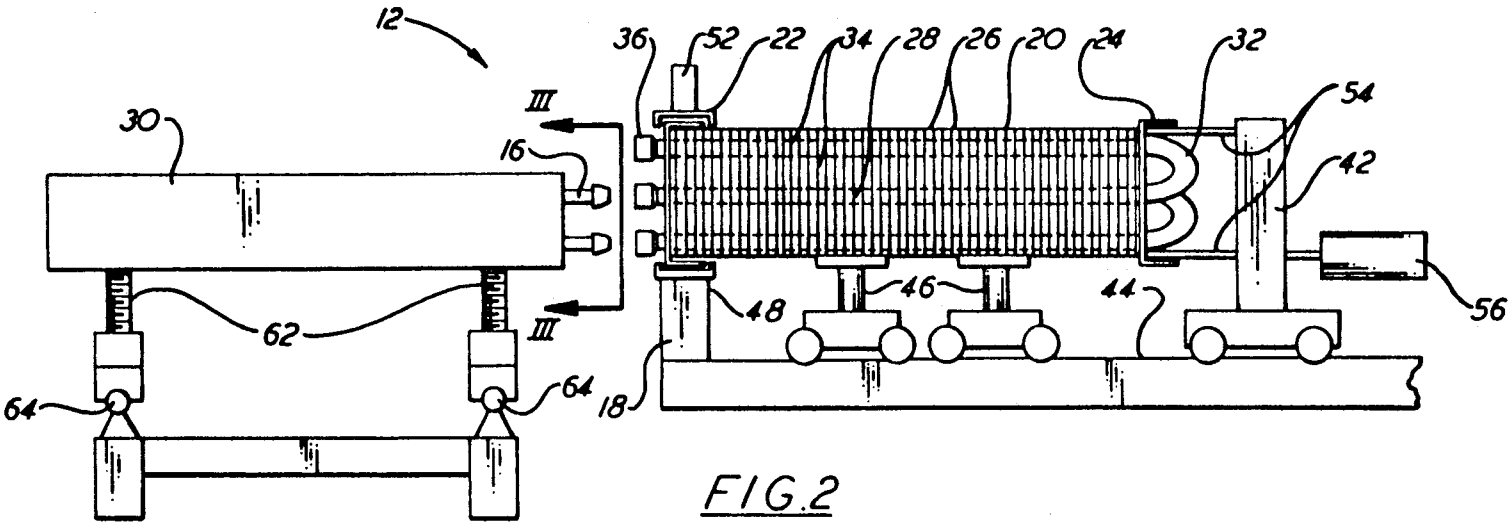
FIG. 2 is a side elevation view of the expansion apparatus of the present invention.

Expander station 12, shown in FIG. 2, includes three bullet rods 16 which are individually actuated by any suitable means, e.g. a hydraulic power source for displacing an equalizer bar connected to the bullet rods. Generally, one bullet rod corresponds to each leg portion of a single hairpin tube such that one hairpin tube may be expanded at a time. Moreover, at the expander station 12, a laterally adjustable carriage 42 is mounted on assembly platform 18. The platform functions to support partially assembled plate fin heat exchangers within the station so that the open ends of the hairpin tubes are in alignment with the bullet rods 16. The carriage moves on rail 44 to allow for different heat exchanger lengths and to assist in supporting the heat exchanger. Further, support means or jacks 46 assist in supporting the heat exchanger on the fins 26.

In operation as illustrated in FIG. 2, the previously laced and belled plate fin heat exchanger 20 is indexed into the expansion station with the top tube sheet 22 positioned directly on tube sheet support fixture 48. Vertically adjustable clamp 52 is adjustable for different top tube sheet widths. The clamp 52 is adjustable by any suitable means, e.g. a hydraulic piston. Support blades 54 supporting the bottom tube sheet 24 are further supported on the laterally adjustable carriage 42. The blades 54 slidingly support the tube sheet 24. The carriage 42 functions to adjust the distance between tube sheet support fixture 48 and blades 54 for different heat exchanger lengths and is actuated by actuator 56 if the coil has to be compressed in size. As can be clearly seen, once the heat exchanger is indexed into the expander station 12, jack means 46 can be operated to raise a sagging plate fin heat exchanger to level the heat exchanger in order that it may be properly expanded.

Upon a heat exchanger 20 being indexed into the expander station 12 and clamped into position by clamp 52 and supported as necessary by jack means 46 and support blades 54 the expander 30 is positioned vertically by lift means 62 and positioned horizontally along the extension portions 36 by means of slides 64. Once a pair of bullet rods 16 are properly located within the belled extension portions 36', the bullet rods 16 are actuated first causing each belled extension portion to seat against tube sheet 22 and then causing each leg of hairpin tube 28 to be expanded into the tube sheets 22, 24 and fins 26 of the heat exchanger. In this manner, the force of expansion is held by the prebelled extension portions 36 bearing against the holes in the top tube sheet 22. Thus, with the tube sheet 22 being held by clamp 52 and support fixture 48, it is unnecessary to hold each bell of each tube or back each hairpin end in a receiver since each stroke results in a small force. The vertical and horizontal motion of the expander 30 may be accomplished either manually by the operator or automatically by a microprocessor based control.

Figure 3:
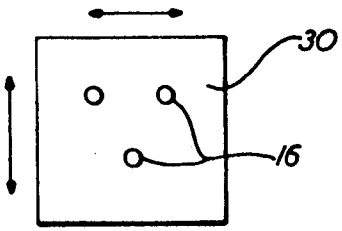
FIG. 3 is a partial section taken along line III—III of FIG. 2.

As shown in FIG. 3, the expander 30 generally comprises three bullet rods 16 which may be actuated either individually for expanding one leg portion 34 at a time, or two out of three at a time for expanding one hairpin tube 28 at a time. As shown, the rods 16 can expand hairpins oriented in any one of three angles. The rods may be changed for different orientations or more rods may be added. The expander 30 is movable both horizontally and vertically as indicated by the arrows to expand a variety of plate fin heat exchanger configurations, thus minimizing set-up time since the motion of the expander to expand individual hairpins eliminates the need to change rods and the flexibility permits integration with any level of automation.

While a preferred embodiment of the present invention has been depicted and described, it will be appreciated by those skilled in the art that many modifications, substitutions, and changes may be made thereto without departing from the true spirit and scope of the invention. For example, although the invention has been described in terms of use with three bullet rods, it may also be used with more or less rods.

What is claimed is:

1. A method of expanding a partially assembled plate fin heat exchanger having a plurality of plate fins and at least one tube sheet laced with a plurality of hairpin tubes having belled open ends and hairpin bend ends comprising the steps of:

supporting the partially assembled plate fin heat exchanger in an expander station;

indexing an expander means, having at least a pair of expanding rods, juxtapose the open ends of each one of the plurality of hairpin tubes;

positioning the bells of said each one of the plurality of hairpin tubes in contact with the tube sheet; and moving said at least a pair of expanding rods into each hairpin tube one at a time to expand each hairpin tube radially outward into contact with the tube sheet and the plurality of plate fins in tension expansion, whereby a small force is exerted on the bells of each hairpin tube in contact with the tube sheet.

2. A method as set forth in claim 1 wherein the step of supporting the partially assembled plate fin heat exchanger further comprises clamping the tube sheet in a fixture to prevent movement of the tube sheet during the expansion of the hairpin tubes.

3. A method as set forth in claim 2 wherein the step of supporting the partially assembled plate fin heat exchanger further comprises matingly engaging a tube sheet at the return bend end to compress the plate fins to form a coil of desired size.

4. A method as set forth in claim 1 wherein the step of indexing an expander means juxtapose the open ends of each one of the plurality of hairpin tubes further includes moving the expansion means in a horizontal direction and a vertical direction whereby a multirow plate fin coil is expanded in tension one hairpin tube at a time.

5. A method as set forth in claim 2 wherein the step of indexing an expander means juxtapose the open ends of each one of the plurality of hairpin tubes further includes moving the expansion means in a horizontal direction and a vertical direction whereby a multirow plate fin coil is expanded in tension one hairpin tube at a time.

6. An apparatus for expanding hairpin tubes, having belled open ends and return bend ends, into at least one tube sheet and a plurality of laced plate fins to form a plate fin heat exchanger comprising:

support means for supporting the desired size plate fin heat exchanger in an expansion station;

clamping means for providing a clamp force to hold the at least one tube sheet on the support means;

a movable expander means, having at least one pair of expanding rods, for individually expanding in tension each hairpin tube radially outward into contact with the tube sheet and the plurality of laced plate fins one hairpin at a time.

7. An apparatus for tension expanding hairpin tubes in a plate fin heat exchanger as set forth in claim 6 wherein said movable expander means includes horizontal positioning means for moving said expander means in a horizontal direction across the belled open ends of a plurality of hairpin tubes and a vertical positioning means for moving said expander means in a vertical direction across the belled open ends of a multirow plate fin heat exchanger.

8. An apparatus for tension expanding hairpin tubes in a plate fin heat exchanger as set forth in claim 7 further including seating means for seating the bells of the belled open ends of the hairpin tubes into contact with the at least one tube sheet wherein the force of expanding the hairpin tubes is transmitted to the at least one tube sheet.

9. An apparatus for tension expanding hairpin tubes in a plate fin heat exchanger as set forth in claim 8 wherein said support means includes at least one vertically adjustable jack means for engaging a plurality of plate fins to inhibit sagging of the heat exchanger and a horizontally adjustable compression means for compressing the plate fins to form a coil of desired length.

* * * * *